US007673455B2

(12) United States Patent
Yoshida et al.

(10) Patent No.: US 7,673,455 B2
(45) **Date of Patent: *Mar. 9, 2010**

(54) GAS TURBINE COMBUSTOR AND FUEL SUPPLY METHOD FOR SAME

(75) Inventors: Shouhei Yoshida, Hitachiohta (JP); Yoshitaka Hirata, Hitachi (JP); Kazuyuki Itou, Hitachinaka (JP); Tomoya Murota, Hitachinaka (JP); Hiroshi Inoue, Mito (JP); Tomohiro Asai, Mito (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/078,217

(22) Filed: Mar. 28, 2008

(65) Prior Publication Data

US 2008/0209909 A1 Sep. 4, 2008

Related U.S. Application Data

(63) Continuation of application No. 10/868,805, filed on Jun. 17, 2004, now Pat. No. 7,426,833.

(30) Foreign Application Priority Data

Jun. 19, 2003 (JP) ..... 2003-175030

(51) Int. Cl.
*F23R 3/14* (2006.01)
*F02C 7/22* (2006.01)

(52) U.S. Cl. ..... 60/737; 60/748

(58) Field of Classification Search ..... 60/737, 60/748

See application file for complete search history.

(56) References Cited

U.S. PATENT DOCUMENTS 1,777,411 A 10/1930 Mayr (Continued)

FOREIGN PATENT DOCUMENTS

JP 57-55975 B2 11/1982

(Continued)

*Primary Examiner*—Ted Kim
(74) *Attorney, Agent, or Firm*—Mattingly & Malur, P.C.

(57) ABSTRACT

A gas turbine combustor includes a liquid fuel nozzle for jetting out liquid fuel; a pre-mixture chamber wall provided with the liquid fuel nozzle at a center thereof, having a hollow conical shape gradually spreading in the direction in which the fuel is jetted out, and defining a pre-mixture chamber therein; a plurality of air inlet holes bored through the pre-mixture chamber wall and introducing the combustion air to the pre-mixture chamber such that angles at which the combustion air is introduced to the pre-mixture chamber through the air inlet holes are deflected at least toward the circumferential direction of the pre-mixture chamber wall; and a plurality of gaseous fuel nozzles disposed around the pre-mixture chamber wall in an opposing relation respectively to the plurality of air inlet holes and jetting out gaseous fuel substantially coaxially with axes of the air inlet holes.

5 Claims, 6 Drawing Sheets

U.S. PATENT DOCUMENTS

| | | | |
|---|---|---|---|
| 4,012,904 | A | 3/1977 | Nogle |
| 4,073,137 | A | 2/1978 | Roberts |
| 5,699,667 | A | 12/1997 | Joos |
| 5,761,906 | A | 6/1998 | Norster |
| 6,094,916 | A | 8/2000 | Puri et al. |
| 6,109,038 | A | 8/2000 | Sharifi et al. |
| 6,263,676 | B1 | 7/2001 | Keller |
| 7,028,483 | B2 | 4/2006 | Mansour et al. |
| 7,047,746 | B2 | 5/2006 | Hellat |
| 7,426,833 | B2 * | 9/2008 | Yoshida et al. ..... 60/737 |

FOREIGN PATENT DOCUMENTS

| | | |
|---|---|---|
| JP | 7-012314 | 1/1995 |
| JP | 8-261466 A | 10/1996 |
| JP | 9-264536 | 10/1997 |

* cited by examiner

GAS TURBINE COMBUSTOR AND FUEL SUPPLY METHOD FOR SAME

The above-reference patent application is a continuation application of U.S. Ser. No. 10/868,805, filed Jun. 17, 2004, now U.S. Pat. No. 7,426,833 which is hereby incorporated by reference into this application.

BACKGROUND OF THE INVENTION

1. Field of the Invention

The present invention relates to a gas turbine combustor for mixing fuel into combustion air introduced from a compressor, burning an air-fuel mixture, and supplying produced combustion gas to a gas turbine. More particularly, the present invention relates to a gas turbine combustor capable of burning either one or both of liquid fuel and gaseous fuel, and to a fuel supply method for the gas turbine combustor.

2. Description of the Related Art

Recently, a demand for higher output and higher efficiency of gas turbine plants has increased, and the temperature of combustion gas tends to rise year by year. Higher temperatures of the combustion gas increase the concentration of nitrogen oxides (hereinafter expressed by NOx) contained in gas turbine exhaust gas correspondingly. In the field of gas turbine combustors, therefore, how to reduce NOx emissions has become an important problem from the viewpoint of protecting the global environment.

With such background in mind, a gas turbine combustor has hitherto been proposed which employs a premixed combustion method capable of avoiding local generation of high-temperature combustion gas and reducing NOx emissions by jetting out fuel from a nozzle into the high-temperature combustion gas and burning an air-fuel mixture after uniformly mixing the fuel and the combustion air in advance.

One example of the gas turbine combustor employing the premixed combustion method comprises a pilot fuel nozzle for producing combustion gas by diffusion combustion, a plurality of main fuel nozzles disposed around the pilot fuel nozzle, a premixing duct formed with a diameter gradually reducing toward the downstream side in the flow direction and mixing fuel jetted out from the main fuel nozzles into introduced combustion air, and a combustion chamber in which premixed gas introduced from the premixing duct is burnt with the diffusion combustion gas acting as an ignition source (see, e.g., Patent Reference 1; JP,A 9-264536). With such a gas turbine combustor, because the premixing duct has a length sufficient to uniformly mix the combustion air and the fuel, homogeneous premixed gas can be produced and hence NOx emissions can be reduced.

The above-described related art, however, has problems given below.

According to the known gas turbine combustor described above, because the premixing duct has a length sufficient to uniformly mix the combustion air and the fuel, the premixed gas is filled in the premixing duct, thus leading to a risk of spontaneous ignition of the premixed gas in the premixing duct or flushing-back of a flame into the premixing duct from the combustion chamber. Also, since dust or the like is often mingled in the combustion air introduced to the combustor during a process in which the combustion air is produced with compression by a compressor and then flows down through channels, the mingled dust or the like may be contained in the combustion air introduced to the premixing duct. If the dust or the like is a combustible material, it may be heated and ignited by the combustion air at high temperatures. In such an event, there is a risk that a flame may remain in an upstream area of the premixing duct where the gas flow speed is relatively low, due to the above-mentioned structure that the premixing duct is formed with a diameter gradually reducing toward the downstream side. The occurrence of that event may bring about overheating of the premixing duct to cause a deformation or breakage thereof, and hence may invite a risk of damage of the gas turbine in its entirety.

With the view of overcoming the above-described problems in the related art, it is an object of the present invention to provide a gas turbine combustor and a fuel supply method for the gas turbine combustor, which can prevent flushing-back of a flame while reducing NOx emissions.

SUMMARY OF THE INVENTION

To achieve the above object, the present invention provides a gas turbine combustor for mixing fuel into combustion air introduced from a compressor, burning an air-fuel mixture, and supplying produced combustion gas to a gas turbine, the combustor comprising a first fuel nozzle for jetting out fuel; a pre-mixture chamber wall provided with the first fuel nozzle at a center thereof, having a hollow conical shape gradually spreading in the direction in which the fuel is jetted out from the first fuel nozzle, and defining a pre-mixture chamber therein; a plurality of air inlet holes bored through the pre-mixture chamber wall and introducing the combustion air to the pre-mixture chamber such that angles at which the combustion air is introduced to the pre-mixture chamber through the air inlet holes are deflected at least toward the circumferential direction of the pre-mixture chamber wall; and a plurality of second fuel nozzles disposed around the pre-mixture chamber wall in an opposing relation respectively to the plurality of air inlet holes and jetting out fuel substantially coaxially with axes of the air inlet holes.

Figure 1:
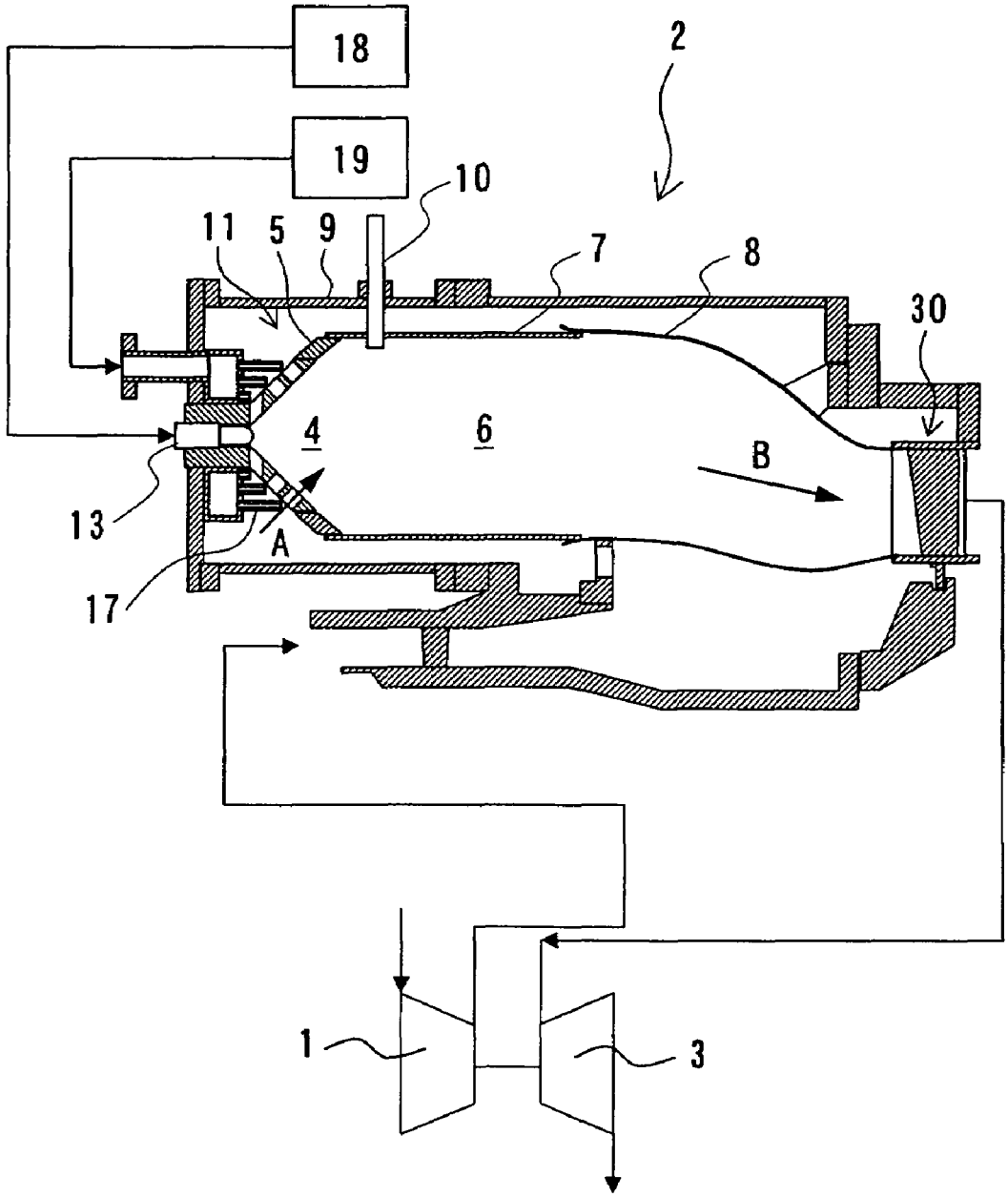
FIG. 1 shows, as a side sectional view, a construction of a gas turbine combustor according to a first embodiment of the present invention, and also shows, as a schematic diagram, an overall construction of a gas turbine plant equipped with the gas turbine combustor.

DESCRIPTION OF THE PREFERRED EMBODIMENTS (1) To achieve the above object, the present invention provides a gas turbine combustor for mixing fuel into combustion air introduced from a compressor, burning an air-fuel mixture, and supplying produced combustion gas to a gas turbine, the combustor comprising a first fuel nozzle for jetting out fuel; a pre-mixture chamber wall provided with the first fuel nozzle at a center thereof, having a hollow conical shape gradually spreading in the direction in which the fuel is jetted out from the first fuel nozzle, and defining a pre-mixture chamber therein; a plurality of air inlet holes bored through the pre-mixture chamber wall and introducing the combustion air to the pre-mixture chamber such that angles at which the combustion air is introduced to the pre-mixture chamber through the air inlet holes are deflected at least toward the circumferential direction of the pre-mixture chamber wall; and a plurality of second fuel nozzles disposed around the pre-mixture chamber wall in an opposing relation respectively to the plurality of air inlet holes and jetting out fuel substantially coaxially with axes of the air inlet holes.

In the gas turbine combustor of the present invention, the fuel is jetted out from the first fuel nozzle into the pre-mixture chamber, and the fuel is jetted out from the plurality of second fuel nozzles disposed around the pre-mixture chamber wall toward the corresponding air inlet holes such that the latter fuel and the combustion air introduced from the compressor are introduced to the pre-mixture chamber through the air inlet holes. Then, the fuel jetted out from the first fuel nozzle, the fuel jetted out from the second fuel nozzles, and the combustion air are mixed in the pre-mixture chamber and burnt in a combustion chamber downstream of the pre-mixture chamber, thereby producing combustion gas supplied to the gas turbine.

Assuming here the case, by way of example, that the air inlet holes are formed to have a length sufficient to uniformly premix the fuel jetted out from the second fuel nozzles and the combustion air as in the structure of the above-mentioned related art, the mixed gas of the fuel and the combustion air would be filled in the air inlet holes, thus resulting in a risk of spontaneous ignition of the mixed gas in the air inlet holes or flushing-back of a flame into the air inlet holes through the pre-mixture chamber. Also, if combustible material dust or the like is contained in the combustion air introduced to the air inlet holes, such dust or the like would be possibly heated and ignited by the combustion air. Consequently, there would be a risk that such dust or the like acts as an ignition source and a flame remains in the air inlet holes. The occurrence of that event would cause a deformation or breakage of the air inlet holes due to overheating, and hence would invite a risk of damage of the gas turbine in its entirety.

In contrast, since the present invention has the structure that the air inlet holes for introducing the combustion air and the fuel jetted out from the second fuel nozzles to the pre-mixture chamber are bored through the pre-mixture chamber wall having a hollow conical shape, the length of each of the air inlet holes effective for mixing is determined depending on the thickness of the pre-mixture chamber wall. Accordingly, the combustion air and the fuel are avoided from mixing so sufficiently in the air inlet holes, whereby spontaneous ignition of the mixed gas or flushing-back of a flame into the air inlet holes can be prevented which have been possibly caused in the known structure described above. Also, even if combustible material dust or the like is contained in the introduced combustion air, such dust or the like is prevented from remaining in the air inlet holes and is immediately jetted into the pre-mixture chamber because each of the air inlet holes has neither the length sufficient for uniform mixing nor the shape with a diameter gradually reducing toward the downstream side unlike the known structure described above. As a result, a flame having flushed back can be avoided from remaining in the air inlet holes. Thus, the present invention is able to prevent flushing-back of a flame.

The operation for reducing NOx emissions in the gas turbine combustor of the present invention will now be described.

In the present invention, the second nozzles are disposed around the pre-mixture chamber wall in an opposing relation respectively to the air inlet holes, and jet out the fuel substantially coaxially with the axes of the air inlet holes. With that arrangement, the combustion air and the fuel both introduced to the air inlet holes are roughly mixed in the air inlet holes (the combustion air and the fuel in this state will be referred to as "roughly mixed gas" hereinafter). Then, the roughly mixed gas is jetted out from the air inlet holes into the pre-mixture chamber. Swirling flows generated upon the jetting-out of the roughly mixed gas promote the mixing (the combustion air and the fuel in this state will be referred to as "primary mixed gas" hereinafter).

Additionally, in the present invention, the air inlet holes are bored through the pre-mixture chamber wall such that angles at which the combustion air is introduced to the pre-mixture chamber through the air inlet holes are deflected at least toward the circumferential direction of the pre-mixture chamber wall. As a result, the primary mixed gas introduced through the air inlet holes is subjected to the swirling action that acts in the circumferential direction of the pre-mixture chamber, thereby generating swirling flows in the pre-mixture chamber. These swirling flows cause respective streams of the primary mixed gas jetted out from the air inlet holes to collide with each other, and hence further promotes mixing of the combustion air and the fuel jetted out from the second fuel nozzles. Furthermore, those swirling flows realize sufficient mixing of the primary mixed gas introduced through the air inlet holes and the fuel jetted out from the first fuel nozzle in the pre-mixture chamber (a resulting mixture in this state will be referred to as "premixed gas" hereinafter).

Thus, since the fuel jetted out from the first fuel nozzle, the fuel jetted out from the second fuel nozzles, and the combustion air are sufficiently mixed in the pre-mixture chamber so as to produce homogenous premixed gas, NOx emissions can be reduced.

According to the present invention, it is therefore possible to prevent the flushing-back of a flame while reducing NOx emissions.

(2) In above (1), preferably, the air inlet holes are bored through the pre-mixture chamber wall such that the angles at which the combustion air is introduced to the pre-mixture chamber through the air inlet holes change depending on axial positions of the pre-mixture chamber wall.

In the present invention, in an upstream area of the pre-mixture chamber, the air inlet holes are arranged to jet out coaxial jet streams of the second fuel and the combustion air toward the vicinity of a jet-out position of the first fuel nozzle, and as approaching a downstream area of the pre-mixture chamber, the air inlet holes are arranged to jet out the coaxial jet streams of the second fuel and the combustion air to flow in a more closely following relation to a wall surface of the pre-mixture chamber. More specifically, assuming that X denotes an offset distance between an axis of each air inlet hole and an axis of the pre-mixture chamber wall and R denotes an inner diameter of the pre-mixture chamber wall at the axial position where the relevant air inlet hole is bored, the air inlet holes are formed through the pre-mixture chamber wall such that a value of X/R increases toward the downstream side in the axial direction of the pre-mixture chamber wall. Thus, at the upstream position in the pre-mixture chamber where the fuel is jetted out from the first fuel nozzle, the value of X/R is relatively small and the primary mixed gas jetted out from each air inlet hole flows toward the vicinity of the axis of the pre-mixture chamber wall (i.e., the vicinity of the jet-out position of the first fuel nozzle). Accordingly, the primary mixed gas can be forced to collide with the fuel jetted out from the first fuel nozzle substantially perpendicularly, and mixing of the fuel and the primary mixed gas can be further promoted by utilizing shearing forces given to the primary mixed gas. As a result, NOx emissions can be further reduced.

On the other hand, at the downstream position in the pre-mixture chamber, the value of X/R is relatively large and the combustion air jetted out from each air inlet hole flows along the inner peripheral surface of the pre-mixture chamber wall. Therefore, the premixed gas produced by mixing of the fuel jetted out from the first fuel nozzle and the primary mixed gas jetted out from the air inlet holes is subjected to strong swirling action in the circumferential direction of the pre-mixture chamber and then flows into a combustion region while generating strong swirling flows in an outlet area of the pre-mixture chamber. As a result, a recirculating flow region of the premixed gas is formed near the position of the axis in the outlet area of the pre-mixture chamber, and stable combustion can be achieved.

With the construction described above, the present invention is adaptable for the case in which the fuel is jetted out only from the first fuel nozzle without jetting out the fuel from the second fuel nozzle. More specifically, for example, even in the case of jetting out liquid fuel only from the first fuel nozzle to employ the gas turbine combustor of the present invention as one dedicated for liquid fuel, the liquid fuel is atomized by shearing forces applied from the combustion air colliding with the liquid fuel substantially perpendicularly at the upstream position in the pre-mixture chamber, as described above, while a part of the liquid fuel is vaporized and gasified. Then, toward the downstream side, mixing of the atomized and gasified fuel and the combustion air is further promoted by the swirling flows. As a result, premixed combustion can be performed at a uniform fuel concentration.

(3) In above (2), more preferably, in an upstream area of the pre-mixture chamber, the air inlet holes are arranged to jet out coaxial jet streams of the second fuel and the combustion air toward the vicinity of a jet-out position of the first fuel nozzle, and as approaching a downstream area of the pre-mixture chamber, the air inlet holes are arranged to jet out the coaxial jet streams of the second fuel and the combustion air to flow in a more closely following relation to a wall surface of the pre-mixture chamber.

(4) In any one of above (1) to (3), preferably, a spreading angle of the pre-mixture chamber wall is set to have a larger value from a predetermined axial position of the pre-mixture chamber wall.

With that feature of the present invention, by setting the spreading angle of the pre-mixture chamber wall to have a larger value from, for example, the position near the outlet of the pre-mixture chamber, the axial speed of the premixed gas can be decelerated in the outlet area of the pre-mixture chamber and a recirculating flow region can be formed around a flame. As a result, flame stability can be further improved.

Also, as mentioned above, by increasing the swirling action of the premixed gas in the outlet area of the pre-mixture chamber, a recirculating flow region is formed near the position of the axis of the pre-mixture chamber and combustion stability can be improved. However, the formation of the recirculating flow region may cause a flame to flush back into the pre-mixture chamber. With the above feature of the present invention, since combustion stability can be further improved, a satisfactory level of combustion stability can be maintained in spite of a decrease in the swirling action of the premixed gas in the outlet area of the pre-mixture chamber. It is hence possible to suppress the flushing-back of a flame into the pre-mixture chamber from the combustion region, while maintaining satisfactory combustion stability, by reducing the swirling action of the premixed gas.

(5) In above any one of (1) to (4), preferably, the first fuel nozzle jets out gaseous fuel or liquid fuel, and the second fuel nozzles jet out gaseous fuel.

With that feature, the gas turbine combustor of the present invention can be employed as one adapted just for gaseous fuel, for example, by operating the combustor to jet out the gaseous fuel from at least either the first fuel nozzle or the second fuel nozzles. Also, the gas turbine combustor can be employed as one adapted just for liquid fuel by operating the combustor to jet out the liquid fuel from only the first fuel nozzle. Further, the gas turbine combustor can be employed as one adapted for the combined use of both liquid fuel and gaseous fuel by operating the combustor to jet out the liquid fuel from the first fuel nozzle and the gaseous fuel from the second fuel nozzles. By modifying the fuel working mode depending on needs in such a manner, it is possible to meet diverse needs for the fuel working mode in various gas turbine plants.

(6) To achieve the above object, the present invention also provides a fuel supply method for a gas turbine combustor for mixing combustion air introduced from a compressor and fuel in a pre-mixture chamber, the method comprising the steps of jetting first fuel into the pre-mixture chamber from the upstream side in the axial direction of the pre-mixture chamber; and jetting a coaxial jet stream of second fuel and the combustion air toward a wall surface of the pre-mixture chamber while deflecting the coaxial jet stream at least toward the circumferential direction of the pre-mixture chamber.

(7) To achieve the above object, the present invention further provides a gas turbine combustor for mixing fuel into combustion air introduced from a compressor in a pre-mixture chamber, burning an air-fuel mixture, and supplying produced combustion gas to a gas turbine, the combustor comprising a first fuel nozzle for jetting out fuel; the pre-mixture chamber being provided with the first fuel nozzle at a center thereof and having a hollow conical shape gradually spreading in the direction in which the fuel is jetted out from the first fuel nozzle; a plurality of air inlet holes formed through an outer peripheral wall of the pre-mixture chamber and introducing the combustion air to the pre-mixture chamber; and a plurality of second fuel nozzles disposed around the pre-mixture chamber in an opposing relation respectively to the plurality of air inlet holes.

(8) To achieve the above object, the present invention still further provides a gas turbine combustor for mixing fuel into combustion air introduced from a compressor in a pre-mixture chamber, burning an air-fuel mixture, and supplying produced combustion gas to a gas turbine, the combustor comprising a first fuel nozzle for jetting out fuel; the pre-mixture chamber having a hollow conical shape gradually spreading in the direction in which the fuel is jetted out from the first fuel nozzle, and being extended in the direction in which the fuel is jetted out from the first fuel nozzle over a distance sufficient to produce premixed gas; a plurality of air inlet holes formed through an outer peripheral wall of the pre-mixture chamber and introducing the combustion air to the pre-mixture chamber; and a plurality of second fuel nozzles disposed around the pre-mixture chamber in an opposing relation respectively to the plurality of air inlet holes.

(9) To achieve the above object, the present invention still further provides a fuel supply method for a gas turbine combustor for mixing combustion air introduced from a compressor and fuel in a pre-mixture chamber, the method comprising the steps of jetting first fuel into the pre-mixture chamber from the upstream side in the axial direction of the pre-mixture chamber; and jetting a coaxial jet stream of second fuel and the combustion air from the outer peripheral side of the pre-mixture chamber.

Embodiments of a gas turbine combustor and a fuel supply method for the same, according to the present invention, will be described below with reference to the drawings.

A first embodiment of the present invention will be first described with reference to FIGS. 1 to 4.

FIG. 1 shows, as a side sectional view, a construction of a gas turbine combustor according to the first embodiment of the present invention, and also shows, as a schematic diagram, an overall construction of a gas turbine plant equipped with the gas turbine combustor.

As shown in FIG. 1, a gas turbine plant mainly comprises a compressor 1 for compressing air and producing combustion air under a high pressure, a combustor 2 for mixing fuel into the compressed air introduced from the compressor 1 and burning an air-fuel mixture to produce combustion gas, and a gas turbine 3 to which the combustion gas produced by the combustor 2 is introduced. The compressor 1 and the gas turbine 3 are coupled to each other.

The combustor 2 comprises a burner 11 having a pre-mixture chamber 4 for mixing the fuel into the combustion air and also having a pre-mixture chamber wall 5 forming the pre-mixture chamber 4 therein, a combustion chamber 6 for burning an air-fuel mixture mixed in the pre-mixture chamber 4 and producing the combustion gas, a liner 7 forming the combustion chamber 6 therein, a transition piece 8 for introducing the combustion gas from the combustion chamber 6 in the liner 7 to the gas turbine 3, a casing 9 for housing the burner 11, the liner 7 and the transition piece 8 therein, and an igniter 10 supported by the casing 9 and igniting the mixed gas in the combustion chamber 6. With such a construction, the compressed air from the compressor 1 is introduced to the pre-mixture chamber 4 as indicated by an arrow A in FIG. 1, and is mixed with the fuel. The resulting mixed gas is ignited by the igniter 10 and burnt in the combustion chamber 6. The combustion gas produced by the combustion is jetted into the gas turbine 3 through the transition piece 8 as indicated by an arrow B in FIG. 1, thereby driving the gas turbine 3. As a result, a generator (not shown) coupled to the gas turbine 3 is driven to generate electric power.

Figure 2:
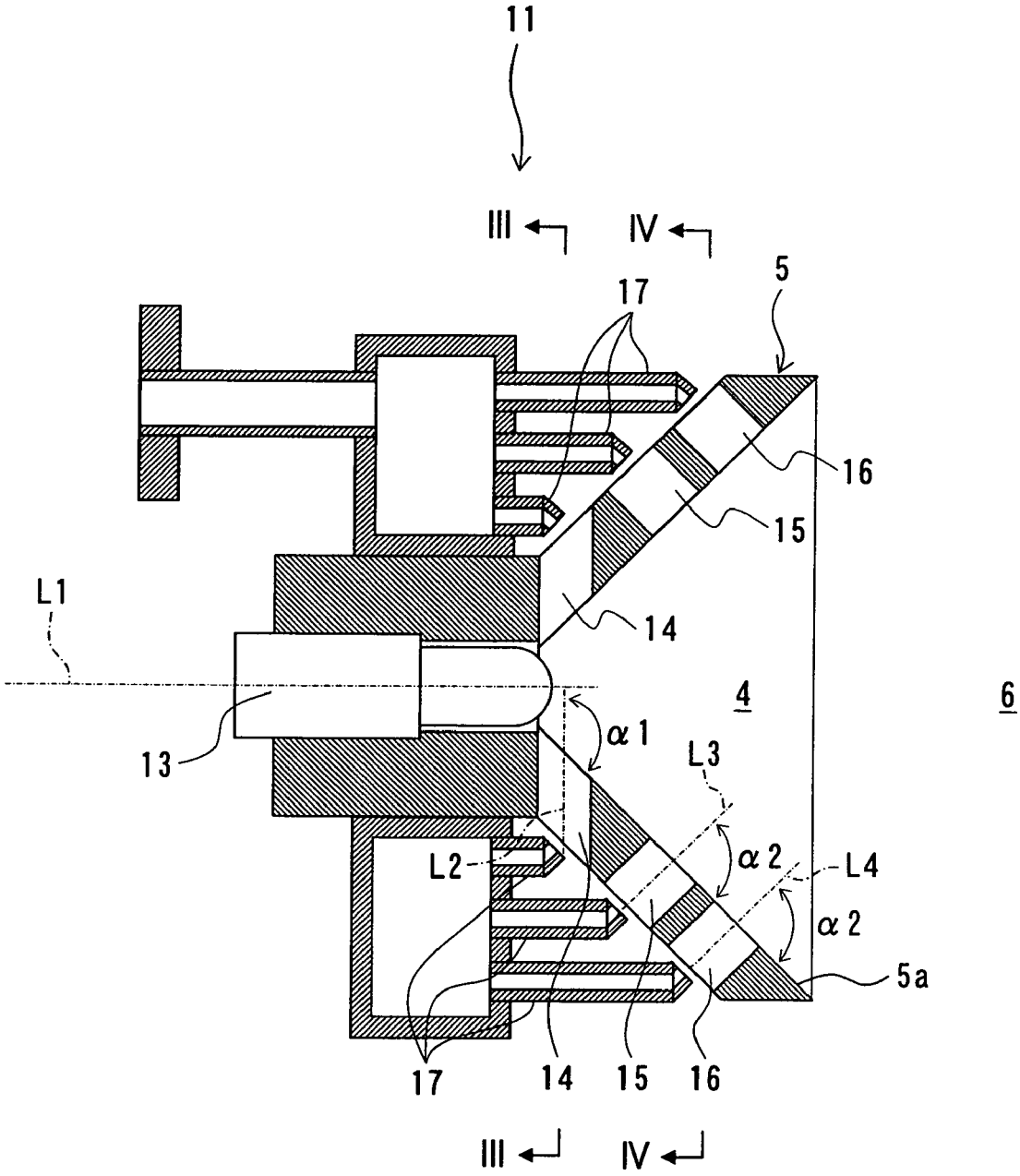
FIG. 2 is a side sectional view showing a detailed structure of a burner constituting the gas turbine combustor according to the first embodiment of the present invention.

FIG. 2 is a side sectional view showing a detailed structure of the burner 11.

As shown in FIG. 2, the pre-mixture chamber wall 5 forming the pre-mixture chamber 4 therein has a hollow conical shape gradually spreading in the direction toward the combustion chamber 6 (to the right in FIG. 2, i.e., the direction in which liquid fuel is jetted out from a liquid fuel nozzle 13 described below). At a top of the cone defined by the pre-mixture chamber wall 5, the liquid fuel nozzle 13 for jetting out liquid fuel toward an upstream area of the combustion chamber 6 is disposed substantially in a coaxial relation to an axis L1 of the pre-mixture chamber wall 5. Further, air inlet holes 14, 15 and 16 for introducing the combustion air from the compressor 1 to the pre-mixture chamber 4 are bored through the pre-mixture chamber wall 5 at plural positions in the circumferential direction thereof and in plural stages (three in this embodiment) in the direction of the axis L1 (hereinafter referred to simply as the "axial direction"). The air inlet holes 14, 15 and 16 are disposed in this order from the upstream side (i.e., from the left side in FIG. 2).

Along an outer periphery of the pre-mixture chamber wall 5, a plurality of gaseous fuel nozzles 17 for jetting out gaseous fuel toward the side upstream of the air inlet holes 14, 15 and 16 are disposed in an opposing relation respectively to the air inlet holes 14, 15 and 16. The gaseous fuel nozzles 17 are able to jet out the gaseous fuel substantially coaxially with axes L2, L3 and L4 of the air inlet holes 14, 15 and 16.

Additionally, the liquid fuel is supplied to the liquid fuel nozzle 13 through a liquid fuel supply system 18, and the gaseous fuel is supplied to the gaseous fuel nozzles 17 through a gaseous fuel supply system 19 (see FIG. 1).

The air inlet holes 14, 15 and 16 are formed such that angles at which the combustion air is introduced to the pre-mixture chamber 4 through those air inlet holes are deflected at least toward the circumferential direction of the pre-mixture chamber wall 5. More specifically, in an upstream area of the pre-mixture chamber 4, the air inlet holes are arranged to jet out coaxial jet streams of the gaseous fuel and the combustion air toward the vicinity of the jet-out position of the liquid fuel nozzle 13. Then, as approaching a downstream area of the pre-mixture chamber 4, the air inlet holes are arranged to jet out the coaxial jet streams of the gaseous fuel and the combustion air to flow in a more closely following relation to an inner peripheral surface 5*a* of the pre-mixture chamber wall 5. That arrangement will be described in more detail with reference to FIGS. 3 and 4, as well as FIG. 2.

Figure 3:
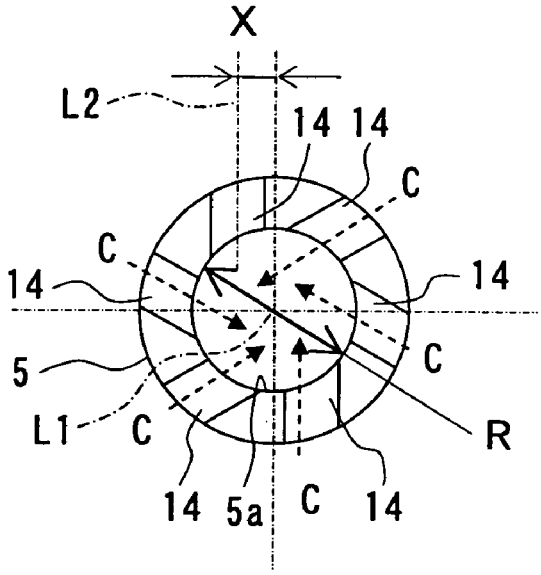
FIG. 3 is a cross-sectional view, taken along a section III-III in FIG. 2, of a pre-mixture chamber wall in the burner constituting the gas turbine combustor according to the first embodiment of the present invention.
Figure 4:
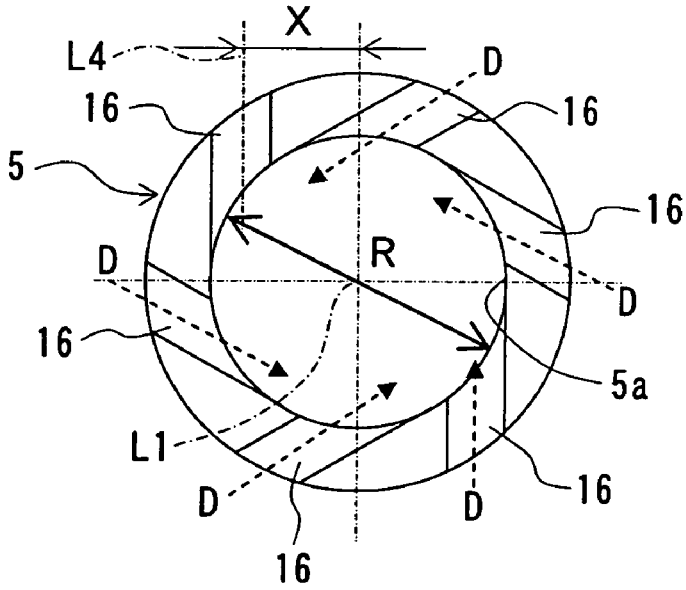
FIG. 4 is a cross-sectional view, taken along a section IV-IV in FIG. 2, of the pre-mixture chamber wall in the burner constituting the gas turbine combustor according to the first embodiment of the present invention.

FIG. 3 is a cross-sectional view (taken along a section III-III in FIG. 2) of the pre-mixture chamber wall 5 at an axial position where the air inlet holes 14 are bored, and FIG. 4 is a cross-sectional view (taken along a section IV-IV in FIG. 2) of the pre-mixture chamber wall 5 at an axial position where the air inlet holes 16 are bored.

Referring to FIGS. 3 and 4, X denotes an offset distance between the axis L2 or L4 of the air inlet hole 14 or 16 and the axis L1 of the pre-mixture chamber wall 5 (i.e., a length of a segment connecting the axis L1 and the axis L2 or L4 perpendicularly to those axes), and R denotes an inner diameter of the pre-mixture chamber wall 5 at the axial position where the air inlet hole 14 or 16 is bored. In this embodiment, circumferential angles of the air inlet holes 14, 15 and 16 are changed such that a value of X/R increases toward the downstream side in the axial direction of the pre-mixture chamber wall 5 (i.e., to the right in FIG. 2). Thus, at the upstream position in the pre-mixture chamber 4, the value of X/R is relatively small and the combustion air jetted out from each air inlet hole 14 flows toward the vicinity of the axis L1 of the pre-mixture chamber wall 5 (i.e., the vicinity of the jet-out position of the liquid fuel nozzle 13) as indicated by an arrow C in FIG. 3. On the other hand, at the downstream position in the pre-mixture chamber 4, the value of X/R is relatively large and the combustion air jetted out from each air inlet hole 16 flows along the inner peripheral surface 5*a* of the pre-mixture chamber wall 5 as indicated by an arrow D in FIG. 4.

Further, in this embodiment, the air inlet holes 14, 15 and 16 are formed to have axial angles changed depending on their positions in the direction of the axis L1. More specifically, as shown in FIG. 2, the air inlet hole 14 formed through the pre-mixture chamber wall 5 at the most upstream position has a relatively large angle $\alpha 1$ formed between the axis L2 thereof and the inner peripheral surface 5*a* of the pre-mixture chamber wall 5 (for example, a substantially right angle at which a plane including the axis L2 of the air inlet hole 14 intersects the axis L1 of the pre-mixture chamber wall 5). On the other hand, the air inlet holes 15, 16 formed through the pre-mixture chamber wall 5 at the intermediate and downstream positions each have a relatively small angle $\alpha$2 (e.g., about 90°) formed between the axis L3 or L4 thereof and the inner peripheral surface 5*a* of the pre-mixture chamber wall 5. As a combination of that arrangement with the above-described effect resulting from setting the value of X/R to be relatively small, the combustion air jetted out from each air inlet hole 14 flows substantially perpendicularly to the axis L1 of the pre-mixture chamber wall 5 (i.e., to the liquid fuel jetted out from the liquid fuel nozzle 13).

The air inlet holes 15, 16 for which the value of X/R is set to be relatively large, as described above, are directed more closely to the circumferential direction, and therefore exit openings of the air inlet holes 15, 16 (on the side facing the pre-mixture chamber 5) each have a size increased to such an extent that, if the air inlet holes 15, 16 are formed at the same angle $\alpha$1 as the air inlet hole 14, the exit openings of two adjacent air inlet holes would interfere with each other. This means that the number of the air inlet holes 15, 16 formed in the circumferential direction must be reduced in such a case. In contrast, in this embodiment, because the angle between the axis L3, L4 of the air inlet hole 15, 16 and the inner peripheral surface 5*a* of the pre-mixture chamber wall 5 is set to the substantially right angle $\alpha$2, the size of the exit opening of each air inlet hole 15, 16 is reduced and hence the air inlet holes 15, 16 can be formed in a sufficient number in the circumferential direction. As a result, the pre-mixture chamber 4 and the pre-mixture chamber wall 5 can be of a compact structure.

In the above description, the liquid fuel nozzle 13 constitutes a first fuel nozzle for jetting out fuel in each Claim, and the gaseous fuel nozzles 17 constitute second fuel nozzles for jetting out fuel substantially coaxially with the axes of the air inlet holes. The liquid fuel jetted out from the liquid fuel nozzle 13 correspond to first fuel in claims 6 and 9, the gaseous fuel jetted out from the gaseous fuel nozzles 17 correspond to second fuel in claims 3, 6, and 9.

The operations and advantages of the gas turbine combustor and the fuel supply method for the same, according to the first embodiment of the present invention, will be described below one by one.

(1) Operation for Preventing Flushing-Back of Flame

In this embodiment, the liquid fuel is jetted out from the liquid fuel nozzle 13 into the pre-mixture chamber 4. At the same time, the gaseous fuel is jetted out from the gaseous fuel nozzles 17 toward the air inlet holes 14, 15 and 16, and the thus-jetted gaseous fuel and the combustion air introduced from the compressor 1 are introduced to the pre-mixture chamber 4 through the air inlet holes 14, 15 and 16. Then, the liquid fuel jetted out from the liquid fuel nozzle 13, the gaseous fuel jetted out from the gaseous fuel nozzles 17, and the combustion air are sufficiently mixed with one another in the pre-mixture chamber 4 to produce homogeneous premixed gas. This premixed gas is burnt in the combustion chamber 6 downstream of the pre-mixture chamber 4, whereby resulting combustion gas is supplied to the gas turbine 3.

If the air inlet holes 14, 15 and 16 are formed to have lengths sufficient to premix the gaseous fuel jetted out from the gaseous fuel nozzles 17 and the combustion air similarly to the structure of the above-mentioned related art, the mixed gas of the gaseous fuel and the combustion air would be filled in the air inlet holes 14, 15 and 16, thus resulting in a risk of spontaneous ignition of the mixed gas in the air inlet holes 14, 15 and 16 or flushing-back of a flame into the air inlet holes 14, 15 and 16 from the combustion chamber 6 through the pre-mixture chamber 4. Also, dust or the like is often mingled in the combustion air introduced to the combustor 2 during a process in which the combustion air is produced with compression by the compressor 1 and then flows down through channels. Accordingly, if combustible material dust or the like is contained in the combustion air introduced to the air inlet holes 14, 15 and 16, there would be a risk that such dust or the like acts as an ignition source and a flame remains in the air inlet holes 14, 15 and 16. The occurrence of that event would bring about overheating of the pre-mixture chamber wall 5 to cause a deformation or breakage thereof, and hence would invite a risk of damage of the gas turbine plant in its entirety.

In contrast, since this embodiment has the structure that the air inlet holes 14, 15 and 16 for mixing the combustion air and the gaseous fuel jetted out from the gaseous fuel nozzles 17 and then introducing the air-fuel mixture to the pre-mixture chamber 4 are bored through the pre-mixture chamber wall 5, the length of each of the air inlet holes 14, 15 and 16 effective for mixing is determined depending on the thickness of the pre-mixture chamber wall 5. Accordingly, the combustion air and the gaseous fuel are avoided from mixing so sufficiently in the air inlet holes 14, 15 and 16, whereby spontaneous ignition of the mixed gas or flushing-back of a flame in or into the air inlet holes 14, 15 and 16 can be prevented which have been possibly caused in the known structure described above. Also, even if combustible material dust or the like is contained in the introduced combustion air, such dust or the like is avoided from remaining in the air inlet holes 14, 15 and 16 and is immediately jetted into the pre-mixture chamber 4 because each of the air inlet holes 14, 15 and 16 has neither the length sufficient for uniform mixing nor the shape with a diameter gradually reducing toward the downstream side unlike the known structure described above. Consequently, a flame having flushed back can be avoided from remaining in the air inlet holes 14, 15 and 16. Thus, the present invention is able to prevent flushing-back of a flame.

(2) Operation for Reducing NOx Emissions

In this embodiment, the gaseous fuel nozzles 17 are disposed around the pre-mixture chamber wall 5 in an opposing relation respectively to the air inlet holes 14, 15 and 16, and jet out the gaseous fuel from the side upstream of in the air inlet holes 14, 15 and 16 substantially coaxially with the axes L2, L3 and L4 thereof. With that arrangement, the combustion air and the gaseous fuel both introduced to the air inlet holes 14, 15 and 16 are roughly mixed in the air inlet holes 14, 15 and 16 (the combustion air and the gaseous fuel in this state will be referred to as "roughly mixed gas" hereinafter). Then, the roughly mixed gas is jetted out from the air inlet holes 14, 15 and 16 into the pre-mixture chamber 4. Swirling flows generated upon the jetting-out of the roughly mixed gas promote the mixing (the combustion air and the gaseous fuel in this state will be referred to as "primary mixed gas" hereinafter). Those swirling flows are similar to those that are usually generated with a structure in which a channel diameter is enlarged in a stepped way.

Further, in this embodiment, the circumferential angles of the air inlet holes 14, 15 and 16 are set to change, as described above, such that the value of X/R increases toward the downstream side in the axial direction of the pre-mixture chamber wall 5. At the upstream position in the pre-mixture chamber 4, therefore, the primary mixed gas jetted out from each air inlet hole 14 flows toward the vicinity of the jet-out position of the liquid fuel nozzle 13. Hence, respective streams of the primary mixed gas jetted out from the air inlet holes 14 are forced to collide with each other at fast speeds, whereby the mixing of them is further promoted. On the other hand, at the intermediate and upstream positions in the pre-mixture chamber 4, the primary mixed gas introduced through the air inlet holes 15, 16 flows along the inner peripheral surface 5*a* of the pre-mixture chamber wall 5. This generates strong swirling flows in the pre-mixture chamber 4, and respective streams of the primary mixed gas jetted out from the air inlet holes 15, 16 are forced to collide with each other by the swirling flows, whereby the mixing of them is greatly promoted. In such a way, the primary mixed gas jetted out from the air inlet holes 14, 15 and 16 is sufficiently mixed in the pre-mixture chamber 4.

Meanwhile, the liquid fuel jetted out from the liquid fuel nozzle 13 is atomized under action of shearing forces applied by the primary mixed gas that is jetted out from the air inlet holes 14 and collides with the jetted-out liquid fuel substantially at a right angle. Further, a part of the atomized liquid fuel is vaporized and gasified and then flows toward the downstream side in the pre-mixture chamber 4 with the swirling flows, thereby promoting mixing of the liquid fuel and the primary mixed gas (a mixture of the liquid fuel, the gaseous fuel, and the combustion air in this state will be referred to as "premixed gas" hereinafter).

Thus, since the liquid fuel, the gaseous fuel, and the combustion air are sufficiently mixed in the pre-mixture chamber 4 so as to produce the homogenous premixed gas, NOx emissions can be reduced.

(3) Operation for Preventing Fuel Deposit

With this embodiment, at the upstream position in the pre-mixture chamber 4 where the value of X/R is set to be relatively small, since the primary mixed gas jetted out from each air inlet hole 14 flows toward the vicinity of the axis L1 of the pre-mixture chamber wall 5 as shown in FIG. 3, strong swirling forces act only in a central area of the pre-mixture chamber 4 and are attenuated to a relatively low level near the inner peripheral surface 5*a* of the pre-mixture chamber wall 5. Accordingly, liquid droplets of the liquid fuel jetted out from the liquid fuel nozzle 13 are avoided from colliding with the inner peripheral surface 5*a* under the swirling action of those swirling flows. It is hence possible to prevent buildup of a fuel deposit.

Also, there often generates a stagnant area where small jetted-out liquid droplets stagnate near the jet-out position of the liquid fuel nozzle 13. Formation of the stagnant area increases a possibility that the liquid droplets adhere to the inner peripheral surface 5*a* of the pre-mixture chamber wall 5, thereby causing buildup of a fuel deposit. With this embodiment, since the primary mixed gas flows toward the vicinity of the fuel jet-out position of the liquid fuel nozzle 13 from the overall region of the pre-mixture chamber wall 5 in the circumferential direction as described above, it is possible to suppress the formation of the stagnant area where the liquid droplets of the liquid fuel are apt to adhere to the inner peripheral surface 5*a* of the pre-mixture chamber wall 5. As a result, buildup of a fuel deposit can be reliably prevented.

Further, liquid droplets having relatively large particle sizes may collide with the inner peripheral surface 5*a* of the pre-mixture chamber wall 5 by their own inertial forces against the swirling forces of the swirling flows. With this embodiment, however, since the air inlet holes 14, 15 and 16 are formed over the entire region of the inner peripheral surface 5*a* of the pre-mixture chamber wall 5 in the circumferential direction, the liquid droplets going to collide with the inner peripheral surface 5*a* can be blown away by the primary mixed gas jetted out from the air inlet holes 14, 15 and 16. As a result, buildup of a fuel deposit can be more reliably prevented.

When the liquid fuel nozzle 13 is constituted as, e.g., a pressure swirl atomize type liquid fuel injector, the liquid droplets jetted out from the liquid fuel nozzle 13 are directed radially outwardly of the axis L1. With this embodiment, even in such a case, since the primary mixed gas flows toward the vicinity of the fuel jet-out position of the liquid fuel nozzle 13 from the overall region of the pre-mixture chamber wall 5 in the circumferential direction as described above, the jetted-out liquid droplets can be suppressed from spreading radially outwardly and can be prevented from colliding with the inner peripheral surface 5*a* of the pre-mixture chamber wall 5. Furthermore, in this case, since shearing forces can be caused to maximally act on the liquid fuel from the primary mixed gas, it is possible to more effectively atomize the liquid droplets and to remarkably promote the mixing.

(4) Operation for Improving Combustion Stability

With this embodiment, the circumferential angles of the air inlet holes 14, 15 and 16 are set to change such that the value of X/R increases toward the downstream side in the axial direction of the pre-mixture chamber wall 5. Therefore, X/R takes a larger value at a more downstream position in the axial direction of the pre-mixture chamber wall 5, and the pre-mixed gas flows into a combustion region while generating strong swirling flows in an outlet area of the pre-mixture chamber 4. As a result, a recirculating flow region is formed near the position of the axis in the outlet area of the pre-mixture chamber 4, and combustion stability can be improved.

Next, a gas turbine combustor and a fuel supply method for the same, according to a second embodiment of the present invention, will be described below with reference to FIG. 5. This second embodiment is featured in that the axial length of the pre-mixture chamber wall is extended and the positions of the air inlet holes are concentrated on the upstream side in the axial direction.

Figure 5:
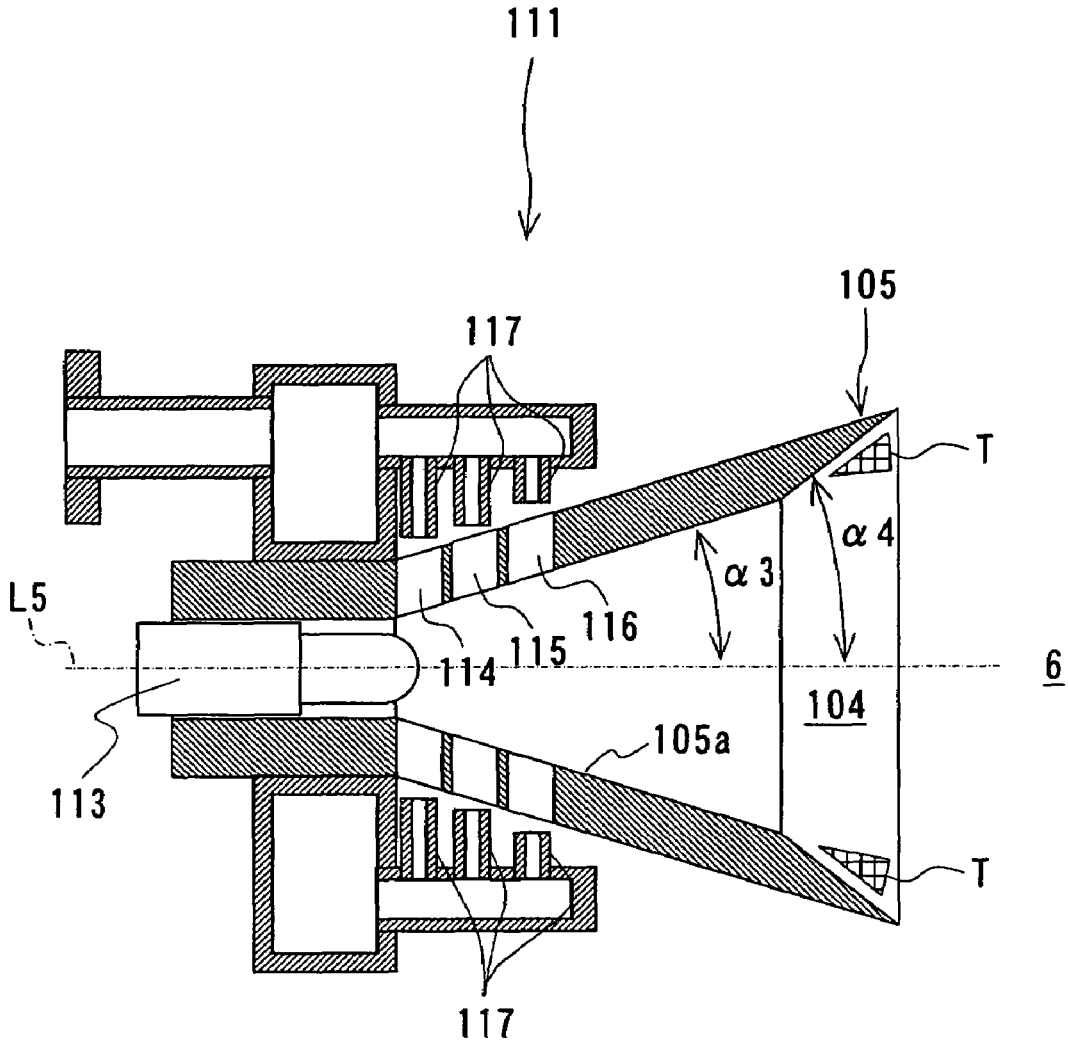
FIG. 5 is a side sectional view showing a detailed structure of a burner constituting a gas turbine combustor according to a second embodiment of the present invention.

FIG. 5 is a side sectional view showing a detailed structure of a burner according to this embodiment. Note that, in FIG. 5, similar components to those in FIG. 2 representing the first embodiment are denoted by the same symbols and a description of those components is omitted here.

As shown in FIG. 5, in a burner 111 according to this embodiment, a pre-mixture chamber wall 105 is formed to gradually spreads at a smaller angle than the pre-mixture chamber wall 5 in the above first embodiment and to have a larger length in the axial direction. Also, air inlet holes 114, 115 and 116 are formed in the pre-mixture chamber wall 105 to locate on the upstream side in a concentrated arrangement. As in the first embodiment, circumferential angles of the air inlet holes 114, 115 and 116 are set to change such that the value of X/R increases toward the downstream side in the axial direction of the pre-mixture chamber wall 105, i.e., that each air inlet hole 114 has a relatively small value of X/R and each air inlet hole 116 has a relatively large value of X/R. Additionally, in this embodiment, axial angles of the air inlet holes 114, 115 and 116 are set not to change depending on their positions in the direction of an axis L5. In other words, the axial angles are set such that planes including respective axes (not shown) of the air inlet holes 114, 115 and 116 intersect the axis L5 substantially perpendicularly.

Upstream of the air inlet holes 114, 115 and 116, a plurality of gaseous fuel nozzle 117 for jetting out gaseous fuel are disposed in an opposing relation respectively to the air inlet holes 114, 115 and 116. As in the first embodiment, therefore, the gaseous fuel is jetted out from the gaseous fuel nozzles 17 substantially coaxially with the axes (not shown) of the air inlet holes 114, 115 and 116.

Further, an inner peripheral surface 105*a* of the pre-mixture chamber wall 105 is formed to gradually spread at a relatively small angle α3 relative to the axis L5 in the upstream and intermediate areas of the pre-mixture chamber 4 and at a relatively large angle α4 in the downstream side thereof. Thus, the inner peripheral surface 105*a* is formed to spread at a relatively large angle in an outlet area of the pre-mixture chamber wall 105.

In operation, this second embodiment thus constructed can provide not only the same advantages as obtainable with the above first embodiment, i.e., prevention of flushing-back of a flame, reduction of NOx emissions, prevention of a fuel deposit, and improvement of combustion stability, but also additional advantages given below.

(5) Operation for Further Improving Combustion Stability

In this embodiment, the pre-mixture chamber wall 105 is formed such that a spreading angle of the inner peripheral surface 105*a* relative to the axis L5 has a relatively large value in the outlet area of the pre-mixture chamber wall 105. Therefore, the axial speed of the premixed gas can be decelerated in the outlet area of the pre-mixture chamber wall 105, and a recirculating flow region (indicated by T in FIG. 5) can be formed around a flame. As a result, retention of a flame is increased to prevent, e.g., flame flickering. Combustion stability can be hence further improved.

(6) Operation for Further Preventing Flushing-Back of Flame

With this second embodiment, a flame can be prevented from flushing back into the air inlet holes 114, 115 and 116 as with the above first embodiment. Also, by creating the swirling flows in the pre-mixture chambers 4, 104 as in the above first embodiment and in this second embodiment, the recirculating flow region is formed near the center of the swirling flows (i.e., near the axes L1, L5) in the outlet area of the pre-mixture chamber, and combustion stability can be improved. In some cases, however, the flame may flush back into the pre-mixture chambers 4, 104 from the combustion region.

In this embodiment, since combustion stability can be further improved as described in above (5), the combustion stability can be retained at a level comparable to that in the first embodiment even if the swirling forces of the premixed gas are weakened in the outlet area of the pre-mixture chamber wall. More specifically, for example, X/R of each of the air inlet holes 114, 115 and 116 can be set to a smaller value to weaken the swirling flows in the outlet area so that the formation of the recirculating flow region is suppressed and flushing-back of a flame is held down. In addition, the spreading angle α4 in the outlet area is enlarged to increase the retention of a flame for maintaining improved combustion stability. Stated another way, it is possible to modify the value of X/R and the spreading angle α4 in the outlet area for adjusting a balance between the swirling forces and the axial speed of the premixed gas, and to keep a flame from flushing back into the pre-mixture chamber 104 from the combustion region while maintaining satisfactory combustion stability. As a result, the flushing-back of a flame can be more reliably prevented.

(7) Operation for Further Reducing NOx Emissions

With this embodiment, since the pre-mixture chamber wall 105 is formed to have a relatively large axial length and the air inlet holes 114, 115 and 116 are arranged on the upstream side in a concentrated way, the distance effective for the mixing in the pre-mixture chamber 104 can be increased. The longer mixing distance further promotes the mixing of the two kinds of gases (gaseous fuel and combustion air) in the primary mixed gas jetted out from the air inlet holes 114, 115 and 116, and increases a rate at which the liquid fuel jet out from the liquid fuel nozzle 113 is vaporized. Accordingly, the mixing of the liquid fuel and the primary mixed gas is further promoted and more homogeneous premixed gas can be produced. As a result, NOx emissions can be further reduced.

(8) Operation for Suppressing Combustion Oscillation

Since the mixing distance effective for producing the premixed gas is increased, this second embodiment can realize combustion characteristics closer to those of premixed combustion than the above first embodiment. In the case of premixed combustion, there may occur a combustion oscillation that the pressure in the combustor 2 (i.e., the pressure in the pre-mixture chamber 104 and the combustion chamber 6) changes cyclically. The combustion oscillation has several oscillation modes. When a particular oscillation mode is excited depending on the combustion state, a pressure amplitude of the combustion oscillation increases. Because the increased pressure amplitude of the combustion oscillation accelerates wears of the sliding surfaces of components of the combustor 2, it is important to prevent the combustion oscillation.

In the case of the gas turbine plant like this second embodiment, when the pressure in the combustor 2 and the pressure in the gas turbine 3 take a certain pressure ratio, the flow speed of the combustion gas generally reaches the speed of sound at a first-stage nozzle throat 30 (see FIG. 1). When a flow speed of a fluid reaches the speed of sound, the fluid is regarded, from the viewpoint of acoustics, as a solid wall in which a sound wave does not propagate. In this embodiment, therefore, the oscillation mode may occur with boundary conditions set to opposite ends of the combustor 2 (i.e., the first-stage nozzle throat 30 and the inlet of the combustor 2). This leads to a risk that a pressure wave is repeatedly reflected between the first-stage nozzle throat 30 serving as one reflection end and the inlet of the combustor 2 serving as the other reflection end, thereby causing resonance and increasing the pressure amplitude.

In this embodiment, since the pre-mixture chamber wall 105 being in the form of a hollow cone and having a small reflectance is disposed at the inlet of the combustor 2 serving as the other reflection end, the pressure wave is damped and the combustion oscillation is suppressed even when the pressure wave propagates in the combustor 2 and strikes against the pre-mixture chamber wall 105. Note that this advantage of suppressing the combustion oscillation can be obtained in the above first embodiment as well.

Next, a gas turbine combustor and a fuel supply method for the same, according to a third embodiment of the present invention, will be described below with reference to FIG. 6. This third embodiment is featured in that the combustion air is introduced to flow around the liquid fuel nozzle.

Figure 6:
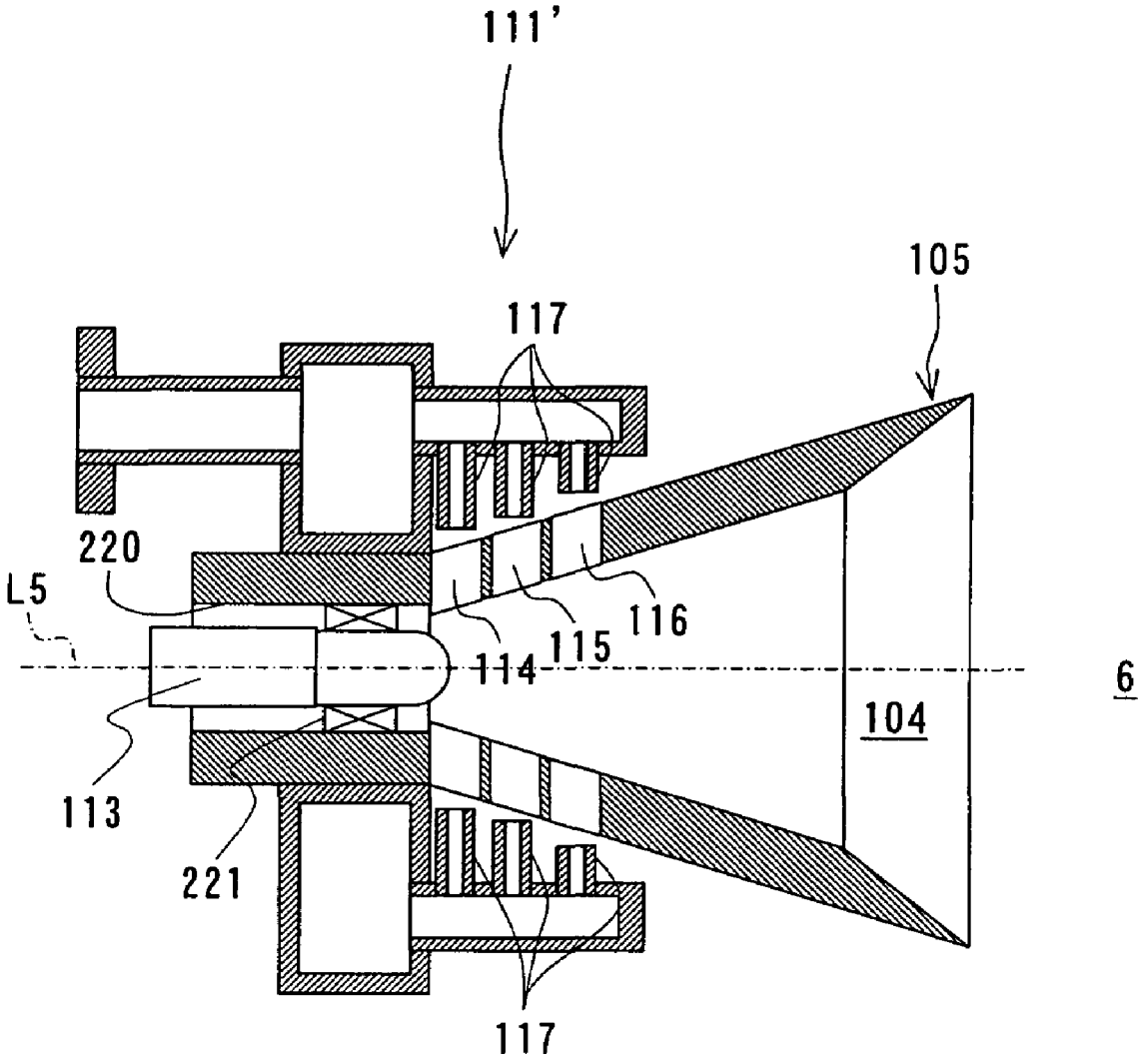
FIG. 6 is a side sectional view showing a detailed structure of a burner constituting a gas turbine combustor according to a third embodiment of the present invention.

FIG. 6 is a side sectional view showing a detailed structure of a burner according to this embodiment. Note that, in FIG. 6, similar components to those in FIG. 5 representing the second embodiment are denoted by the same symbols and a description of those components is omitted here.

As shown in FIG. 6, in a burner 111' according to this embodiment, a channel 220 is formed to allow a part of the combustion air to flow along the radially outward side of the liquid fuel nozzle 113, and a swirler 221 is disposed at an outlet of the channel 220. The swirler 221 gives swirling forces to the combustion air flowing through the channel 220 and entering the pre-mixture chamber 104, thereby causing swirling flows.

In operation, this third embodiment thus constructed can provide not only the same advantages as obtainable with the above second embodiment, but also additional advantages given below.

As described above in (3) with regards to the first embodiment, in the first and second embodiments, since the primary mixed gas flows toward the vicinity of the fuel jet-out position of the liquid fuel nozzle 13, 113 from the overall region of the pre-mixture chamber wall in the circumferential direction, it is possible to suppress the formation of the stagnant area where the liquid droplets of the liquid fuel are apt to adhere to the pre-mixture chamber wall. However, the formation of the stagnant area cannot be perfectly prevented, thus leading to a possibility that the stagnant area may be formed in an area near the fuel jet-out position where the jetted-out primary mixed gas does not reach.

With this third embodiment, as described above, the combustion air is jetted out from the outer peripheral side of the liquid fuel nozzle 113 in the same direction as the jetting-out direction of the liquid fuel (i.e., in the axial direction) while swirling circumferentially. This arrangement enables streams of the combustion air to collide with each other from both the axial and radial directions near the fuel jetted-out position of the liquid fuel nozzle 113, and is effective in preventing the formation of the stagnant area. As a result, buildup of a fuel deposit can be more reliably prevented.

In the above-described first to third embodiments of the present invention, while types of the liquid fuel nozzles 13, 113 and the gaseous fuel nozzles 17, 117 are not specifically mentioned, the liquid fuel nozzles 13, 113 may be each any atomize type liquid fuel nozzle, such as a pressure swirl atomizing nozzle (simplex or duplex type), a pressure impact atomizing nozzle, or an air atomizing nozzle. Also, while only one liquid fuel nozzle 13 or 113 is disposed in any of the embodiments, the present invention is not limited to such an arrangement, and a plurality of liquid fuel nozzles may be disposed for one pre-mixture chamber.

On the other hand, the gaseous fuel nozzles 17, 117 may be each any type nozzle so long as it is able to supply the gaseous fuel to the corresponding air inlet hole in a substantially coaxial relation. Also, the flow rate of the gaseous fuel supplied to particular one of the plurality of air inlet holes may be controlled or blocked off as required.

Furthermore, in the above-described first to third embodiments of the present invention, two kinds of fuel, i.e., the liquid fuel and the gaseous fuel, are jetted out from the liquid fuel nozzles 13, 113 and the gaseous fuel nozzles 17, 117 for combined use in the gas turbine combustor, but the present invention is not limited to those embodiments. More specifically, the liquid fuel may be jetted out from only the liquid fuel nozzles 13, 113, by way of example, so that the gas turbine combustor operates using only the liquid fuel. Further, the liquid fuel nozzles 13, 113 may be each constituted as, e.g., a dual fuel injector capable of jetting out both the gaseous fuel and the liquid fuel, and the gaseous fuel may be jetted out from at least one of the dual fuel injector and the gaseous fuel nozzles 17, 117 so that the gas turbine combustor operates using only the gaseous fuel. By modifying the fuel working mode depending on needs in such a manner, it is possible to meet diverse needs for the fuel working mode in various gas turbine plants.

Next, a gas turbine combustor and a fuel supply method for the same, according to a fourth embodiment of the present invention, will be described below with reference to FIG. 7. This fourth embodiment is featured in that the burner according to the first embodiment is disposed as a pilot burner at the center and the burner according to the second embodiment is disposed in plural as main burners around the pilot burner, thereby constituting a combustor in combination of those pilot and main burners.

Figure 7:
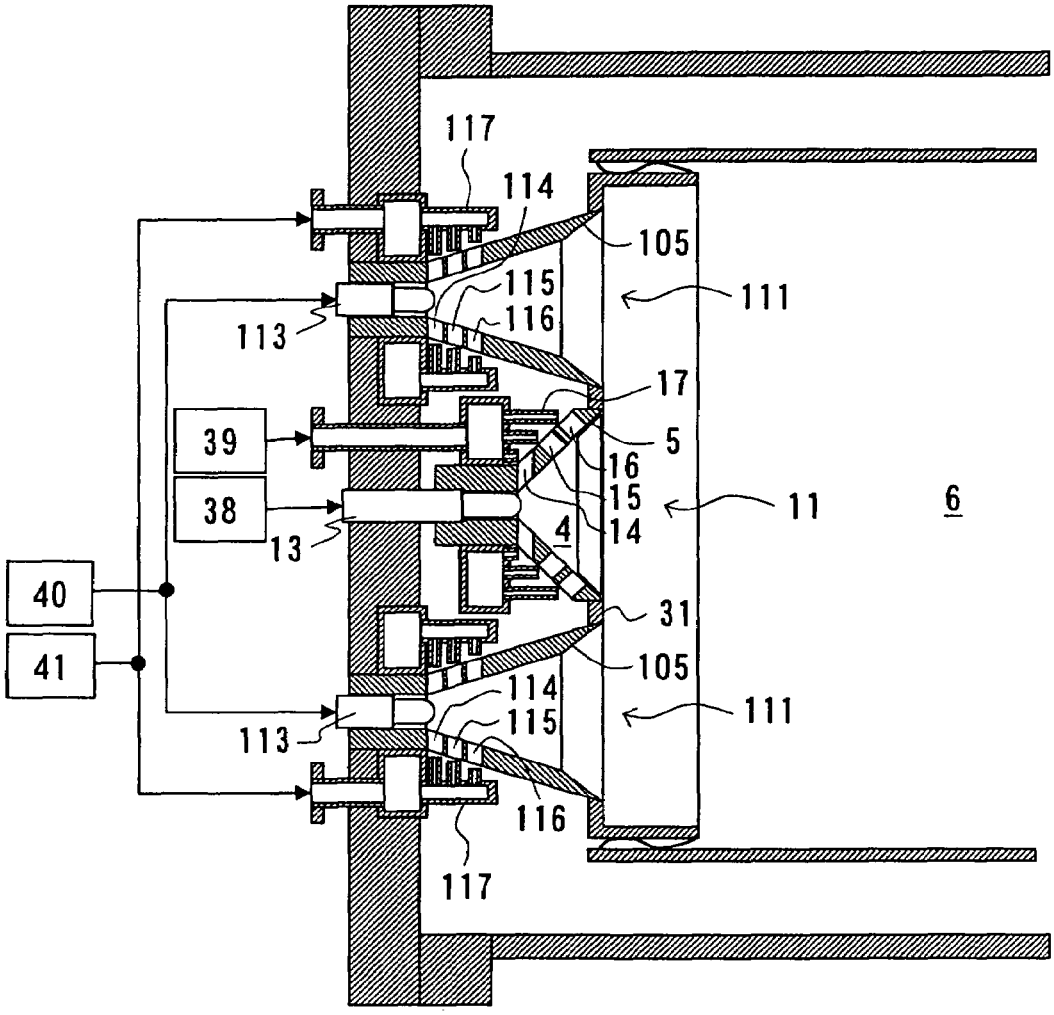
FIG. 7 is a side sectional view showing, in enlarged scale, an inlet portion of a gas turbine combustor according to a fourth embodiment of the present invention.

FIG. 7 is a side sectional view showing, in an enlarged scale, an inlet section of the combustor according to this embodiment. Note that, in FIG. 7, similar components to those in FIGS. 2 and 5 representing the first and second embodiment are denoted by the same symbols and a description of those components is omitted here.

As shown in FIG. 7, in this embodiment, the burner 11 according to the first embodiment is disposed as a pilot burner at the center of an inlet of the combustion chamber 6 and the burner 111 according to the second embodiment is disposed in plural as main burners around the pilot burner. Further, a plate 31 is disposed between an exit edge of the pilot burner 11 and an exit edge of each main burner 111 adjacent to the former for the purpose of assisting retention of a flame. In addition, a liquid fuel supply system 38 and a gaseous fuel supply system 39 are connected respectively to the liquid fuel nozzle 13 and the gaseous fuel nozzles 17 of the pilot burner 11. A liquid fuel supply system 40 and a gaseous fuel supply system 41 are connected respectively to the liquid fuel nozzle 113 and the gaseous fuel nozzles 117 of the main burner 111.

More specifically, because the burner 11 according to the first embodiment is formed to have a larger spreading angle of the pre-mixture chamber wall 5 and a shorter mixing distance in the axial direction than those of the burner 111 according to the second embodiment with the air inlet holes 14, 15 and 16 formed to entirely cover the upstream, intermediate and downstream areas of the pre-mixture chamber wall 5, a temperature rise of the pre-mixture chamber wall 5 can be held down even when a flame approaches the pre-mixture chamber 4. Accordingly, a mass flow ratio (so-called equivalence ratio) of a flow rate of the fuel (i.e., the liquid fuel or the gaseous fuel or both of the liquid fuel and the gaseous fuel) to a flow rate of the combustion air can be set to be relatively high so that the burner 11 operates with stable combustion in a combustion state closer to diffusion combustion than that in the burner 111. In this embodiment, taking into account such a property, the burner 11 is employed as the pilot burner that is ignited from the startup and speed-up stage of the gas turbine plant in which the equivalence ratio and the flow rate of the combustion gas change in a relatively abrupt way.

On the other hand, as compared with the burner 11, the burner 111 according to the second embodiment is formed to have a longer mixing distance in the axial direction, and hence exhibits combustion characteristics closer to the premixed combustion and has a narrower range of combustion stability. In this embodiment, therefore, the burner 111 is employed as the main burner that is ignited from the low-load stage (i.e., the condition after the startup and speed-up stage) of the gas turbine plant in which changes in the flow rate of the combustion gas change become relatively small. Then, a combustion rate of the burner 111 is increased after the operation of the gas turbine plant has come into the state of constant load. As a result, NOx emissions can be reduced.

With this fourth embodiment thus constructed, since the burner 11 and the burner 111 having different combustion characteristics are used in combination, stable combustion can be realized over a wide range of load variations from the startup and speed-up stage to the constant-load stage of the gas turbine plant.

While the above fourth embodiment of the present invention employs two types of burners having different structures as the pilot burner and the main burner, the present invention is not limited to such an arrangement and the burners having the same structure may be used as both the burners. For example, since the burner 11 according to the first embodiment can operated so as to change from the diffusion combustion state to the premixed combustion state just by controlling the flow rate of the fuel, the burner 11 may be used as both of the pilot burner and the main burner. This modification can also provide similar advantages to those obtainable with the fourth embodiment.

In short, according to the present invention, the air inlet holes for introducing the combustion air and the fuel jetted out from the second fuel nozzles to the pre-mixture chamber are bored through the pre-mixture chamber wall in the form of a hollow cone so as to have a short mixing distance. Therefore, the combustion air and the fuel are not so sufficiently mixed in the air inlet hole, whereby spontaneous ignition of the gas mixture and flushing-back of a flame in and into the air inlet hole can be prevented. Also, even when the combustion air introduced to the combustor contains dust or the like, the dust or the like can be immediately jetted out from the air inlet hole into the pre-mixture chamber, a flame having flushed back can be avoided from remaining in the air inlet hole. It is hence possible to prevent the flushing-back of a flame while reducing NOx emissions.

What is claimed is:

1. A gas turbine combustor for mixing fuel into combustion air introduced from a compressor, burning an air-fuel mixture, and supplying produced combustion gas to a gas turbine, the combustor comprising:

a first fuel nozzle for jetting out fuel;

a pre-mixture chamber wall provided with said first fuel nozzle at a center thereof, having a hollow conical shape gradually spreading in the direction in which the fuel is jetted out from said first fuel nozzle, and defining a pre-mixture chamber therein;

a channel formed along the radially outward side of said first fuel nozzle for allowing said combustion air to flow into said pre-mixture chamber;

a swirler for exerting swirling forces to the combustion air flowing through said channel and entering said pre-mixture chamber;

a plurality of air inlet holes bored through said pre-mixture chamber wall and introducing the combustion air to said pre-mixture chamber such that angles at which the combustion air is introduced to said pre-mixture chamber through said air inlet holes are deflected at least toward the circumferential direction of said pre-mixture chamber wall; and a plurality of second fuel nozzles disposed around said pre-mixture chamber wall in an opposing relation respectively to said plurality of air inlet holes.

2. A gas turbine combustor according to claim 1, wherein said air inlet holes are bored through said pre-mixture chamber wall such that the angles at which the combustion air is introduced to said pre-mixture chamber through said air inlet holes change depending on axial positions of said pre-mixture chamber wall.

3. A gas turbine combustor according to claim 2, wherein, in an upstream area of said pre-mixture chamber, said air inlet holes are arranged to jet out coaxial jet streams of the second fuel and the combustion air toward the vicinity of a jet-out position of said first fuel nozzle, and as approaching a downstream area of said pre-mixture chamber, said air inlet holes are arranged to jet out the coaxial jet streams of the second fuel and the combustion air to flow in a more closely following relation to a wall surface of said pre-mixture chamber.

4. A gas turbine combustor according to claim 1, wherein a spreading angle of said pre-mixture chamber wall is set to have a larger value from a predetermined axial position of said pre-mixture chamber wall.

5. A gas turbine combustor according to claim 1, wherein said first fuel nozzle jets out gaseous fuel or liquid fuel, and said second fuel nozzles jet out gaseous fuel.

* * * * *